US006989761B2

(12) United States Patent
Stekelenburg

(10) Patent No.: US 6,989,761 B2
(45) Date of Patent: Jan. 24, 2006

(54) PHOTO-TIMER MODULE

(75) Inventor: Albert Stekelenburg, Taipei (TW)

(73) Assignee: All-Line Inc., Taipei (TW)

( * ) Notice: Subject to any disclaimer, the term of this patent is extended or adjusted under 35 U.S.C. 154(b) by 363 days.

(21) Appl. No.: 10/283,042

(22) Filed: Oct. 30, 2002

(65) Prior Publication Data

US 2004/0085859 A1 May 6, 2004

(51) Int. Cl.
*G08B 5/22* (2006.01)

(52) U.S. Cl. ..... 340/815.45; 340/815.4; 340/525; 368/11; 368/107; 396/213; 396/235; 396/263; 396/264

(58) Field of Classification Search ..... 340/815.45, 340/815.4, 815.47, 815.72, 525; 396/263, 396/264, 100, 213, 219, 183, 235; 368/11, 368/107

See application file for complete search history.

(56) References Cited

U.S. PATENT DOCUMENTS 5,491,464 A * 2/1996 Carter et al. ..... 340/425.5
6,238,043 B1 * 5/2001 Silverbrook ..... 347/86
6,416,160 B1 * 7/2002 Silverbrook ..... 347/32
6,804,026 B1 * 10/2004 Walmsley ..... 358/1.9

* cited by examiner

*Primary Examiner*—Davetta W. Goins

(74) *Attorney, Agent, or Firm*—Troxell Law Office, PLLC

(57) ABSTRACT

A photo-timer module, including a upper cover which has a hollow window; a lower cover which could affix to said upper cover; a control and power circuit which is placed into said upper cover, wherein a portion of said control and power circuit is revealed in said hollow window, said control and power circuit has a plurality of input pins and a plurality of output pins wherein the plurality of input pins and the plurality of output pins are stretching out of said lower cover; a mask plate placing above said hollow window comprises at lease one hole thereon, so that a portion of said control and power circuit is revealed in said hollow window, and a transparent plate placing above said mask plate is used for protecting and convenient observing said control and power circuit. After assembly, said control and power circuit could control a power on or off by sensing variation of a light and show the status on said hollow window.

14 Claims, 4 Drawing Sheets

PHOTO-TIMER MODULE

FIELD OF THE INVENTION

The present invention relates generally to a timer. More particularly, the present invention relates to a photo-timer module.

BACKGROUND OF THE INVENTION

Previous photo-control timer consisting mainly of input power outlet, output power outlet and is forming a single product. According with the molding vibration of the timer, respectively place button, photo-sense device, display window, LED indicator etc. on the photo-control timer. Such type photo-control timer has been used for a long time. Once a vibration of function, structure or molding has been made, the molding or housing of the photo-control timer must be redesigned. Therefore, results in waste and increases production cost.

As a result, an improved photo-control timer that reduces production time, defects, and lower production costs is needed.

SUMMARY OF THE INVENTION

It is an object of the present invention to provide a photo-timer module that reduces production time, defects, and lower production costs.

In accordance with one embodiment of the invention, an photo-timer module is provided comprising: an upper cover which has a hollow window; a lower cover which could affix to said upper cover; a control and power circuit which is placed into said upper cover, wherein a portion of said control and power circuit is revealed in said hollow window, said control and power circuit has a plurality of input pins and a plurality of output pins, wherein the plurality of input pins and the plurality of output pins are stretching out of said lower cover; a mask plate placing above said hollow window comprises at lease one hole thereon, so that a portion of said control and power circuit is revealed in said hollow window, and a transparent plate placing above said mask plate is used for protecting and convenient observing said control and power circuit; after assembly, said control and power circuit could control a power on or off by sensing variation of a light and show the status on said hollow window.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
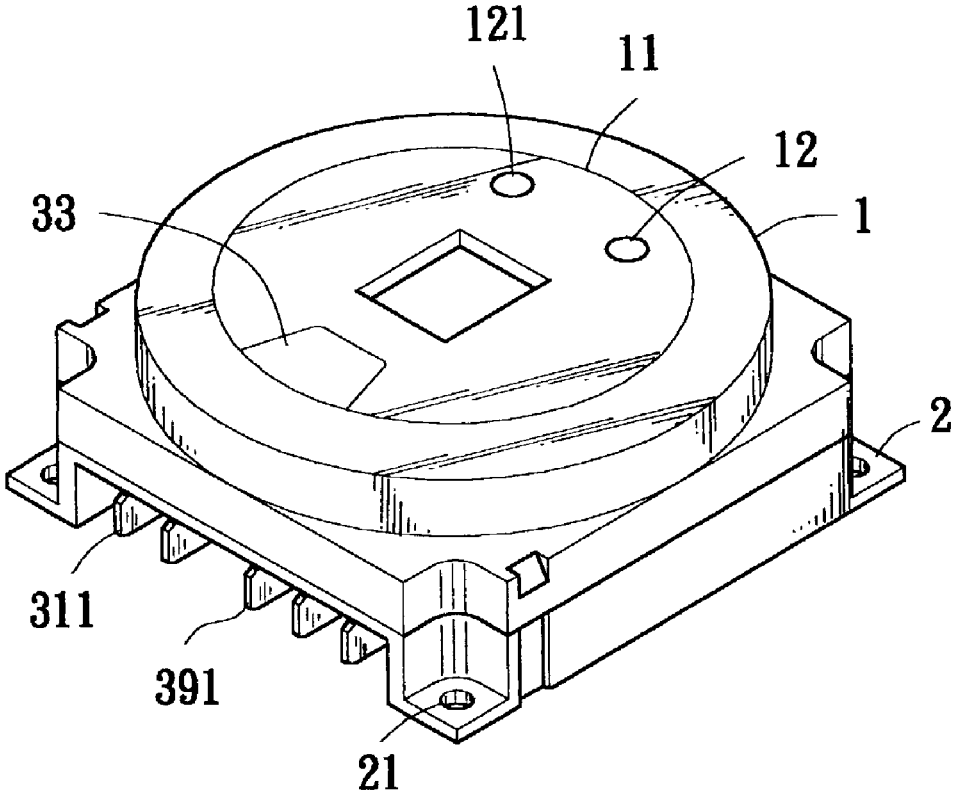
FIG. 1 is an assembly view of a photo-timer module in accordance with one embodiment of the present invention.

Referring first to FIG. 1, there is shown an assembly view of a photo-timer module in accordance with one embodiment of the present invention. The photo-timer module comprises: an upper cover 1; a lower cover 2; a control and power circuit 3.

Wherein, the upper cover 1 has a hollow window 11 in shape of circle which could place a mask plate 12 over it and offers at least one hole 121 on the mask plate 12 so that a portion of the control and power circuit 3 is revealed in said hollow window 11 for convenient observing; a transparent plate 13 placing above the mask plate 12 is used for protecting the control and power circuit 3 and increasing the pleasing to the eye. The lower cover 2 could affix to the upper cover 1 and one side of the lower cover 2 is connecting with the upper cover 1. The lower cover 2 further comprises a plurality of holes 21 for fixing.

Figure 2A:
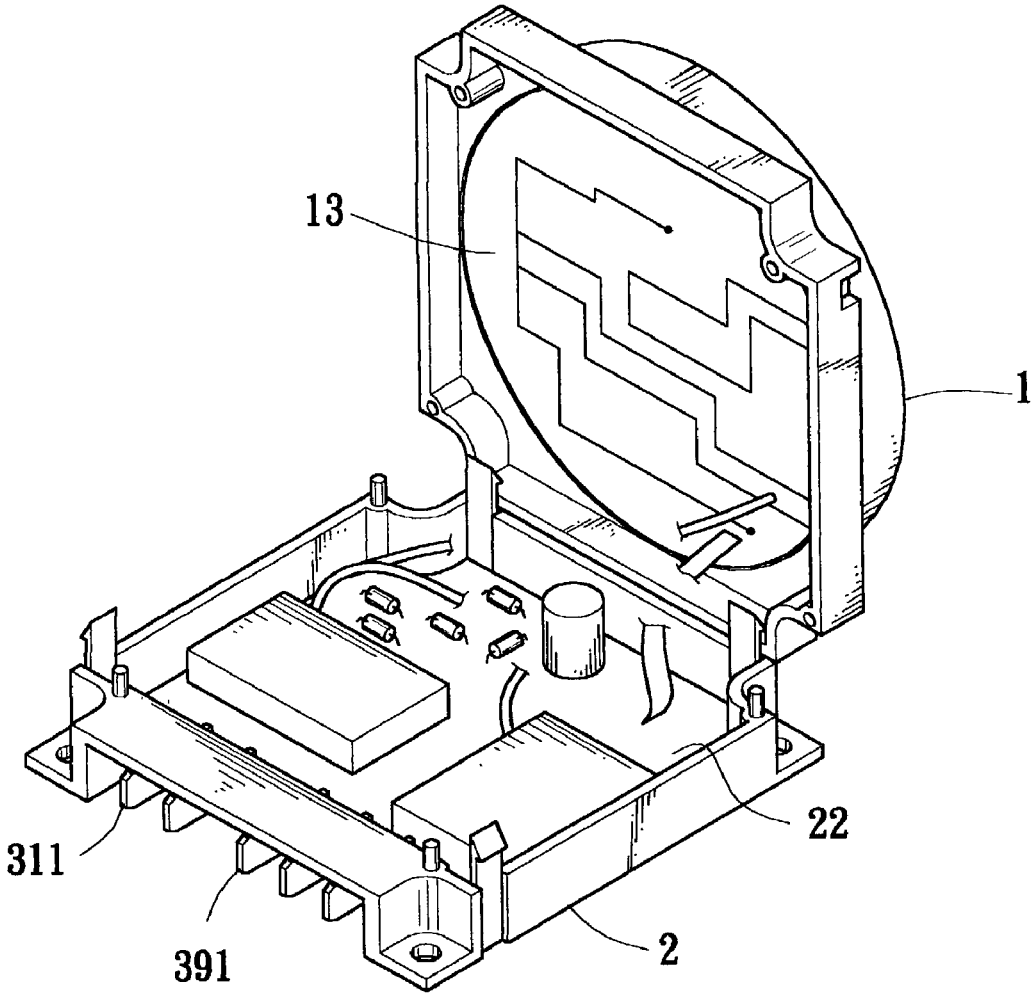
FIGS. 2(*a*) and (*b*) are explosive views of a photo-timer module in accordance with one embodiment of the present invention.
Figure 2B:
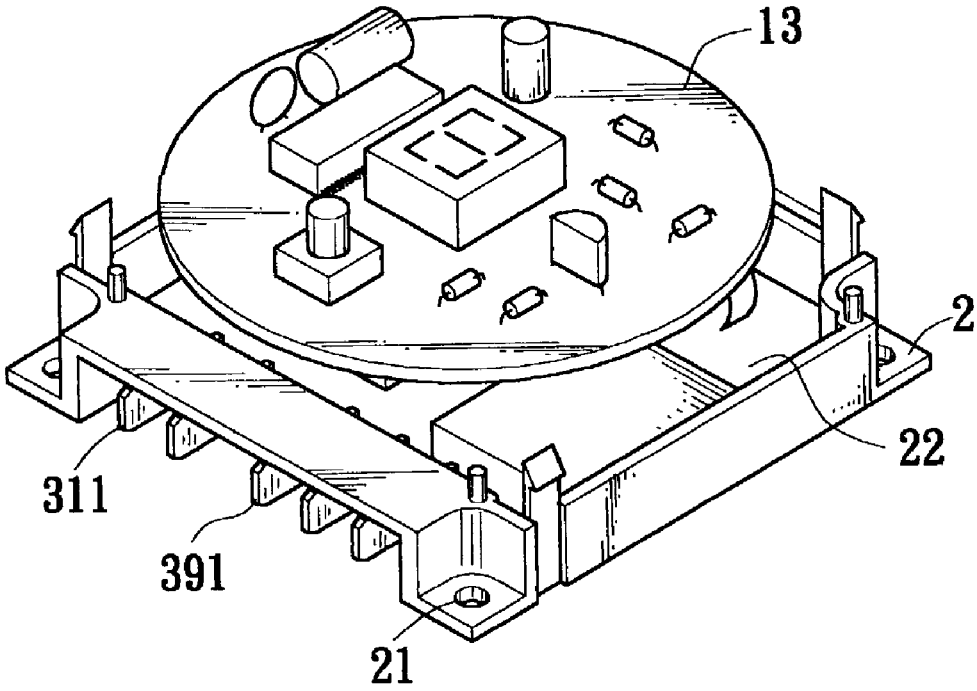

Referring first to FIGS. 2(*a*) and 2(*b*), there are shown explosive views of a photo-timer module in accordance with one embodiment of the present invention. The control and power circuit 3 of the photo-timer module is disposed on two print circuit boards, wherein the first print circuit board 14 is placed into the upper cover 1 and a portion of the control and power circuit 3 is revealed in said hollow window 11, another print circuit board 22 is placed into the lower cover 2 which could connect to the first print circuit board 14 by a wire. The lower cover 2 has a plurality of input pins 311 and a plurality of output pins 391 wherein the plurality of input pins 311 and the plurality of output pins 391 are stretching out of the lower cover 2; the first print circuit board 14 could stack on the second print circuit board 22 during assembly for saving space.

Figure 3:
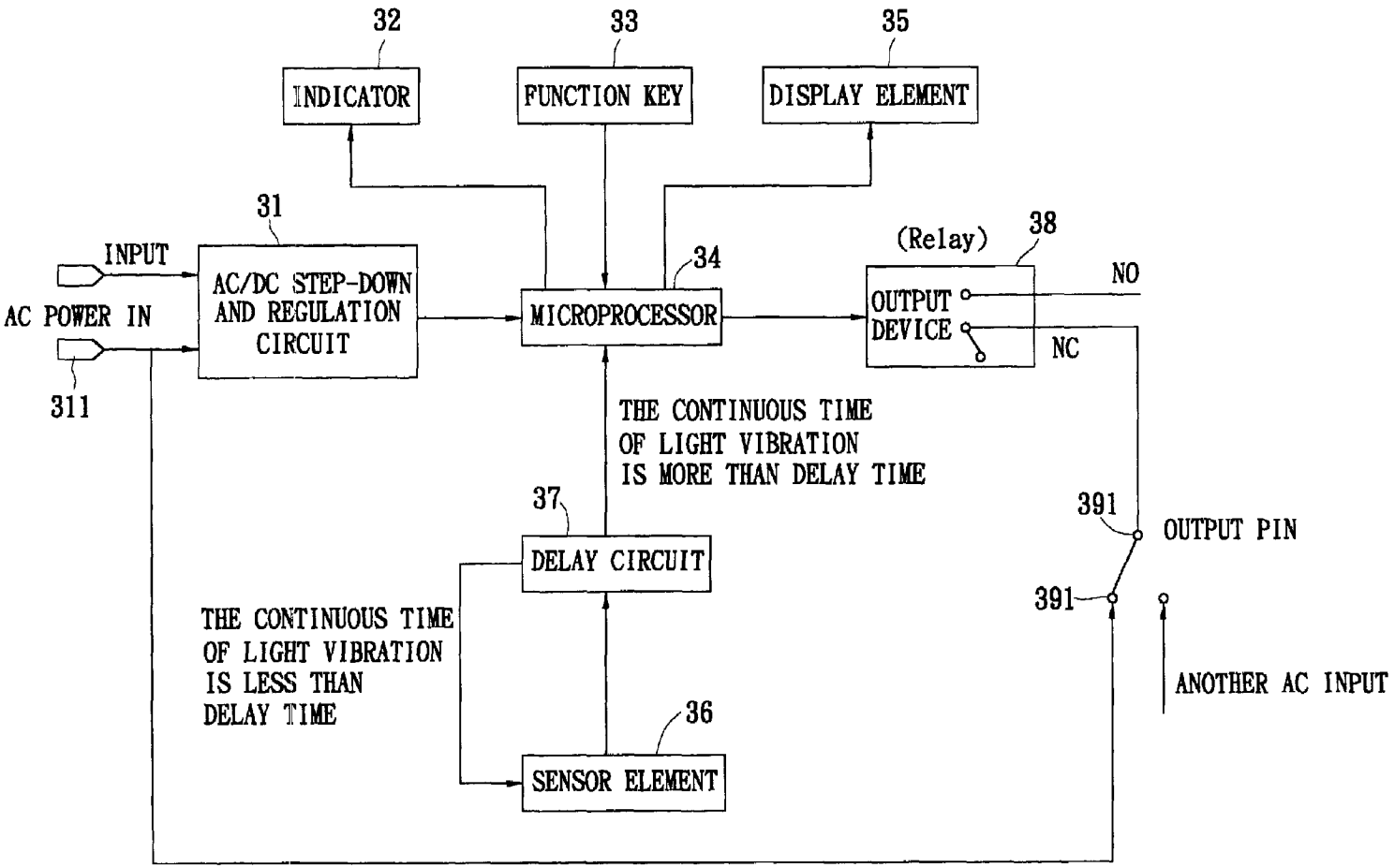
FIG. 3 is a block diagram of a control and power circuit of the photo-timer module in accordance with one embodiment of the present invention.

Referring first to FIG. 3, there is shown a block diagram of the control and power circuit of the photo-timer module in accordance with one embodiment of the present invention. The control and power circuit 3 of the photo-timer module comprises: an AC/DC step-down and regulation circuit 31 is coupled to a AC power source (not shown) for rectification the AC power source into a DC power and regulation the DC power; an indicator 32 for indicating a output status of the control and power circuit 3, wherein a neon lamp is preferably; a function key 33 for selecting a functional mode; a micro-controller 34 is coupled to the AC/DC step-down and regulation circuit 31, the indicator 32 and the function key 33, for controlling the operation of the control and power circuit 3 according with the setting of the function key 33; a display element 35 is coupled to the micro-controller 34 for accepting the controlling of the micro-controller 34 for displaying the functional mode, wherein a 7-segment LED display is preferably; a sensor element 36 for sensing a dawn/dark status, wherein a photo-resistor is preferably; a delay circuit 37 is coupled to the sensor element 36 for determining the dawn/dark status that is sensed whether continues a delay time or not for the purpose of avoiding error action due to short-time shadow or light; and an output device 38 is coupled to the micro-controller 34 for accepting the controlling of the micro-controller 34 to make said AC power source become normal open or normal close, wherein a relay is preferably.

Wherein, sensing the dawn/dark status of the sensor element 36 must continues at least 15 seconds for the purpose of avoiding error action due to short-time shadow or light. While the display sequence of functional mode of the function key 33 is F ·O ·1 ·2 ·3 ·4 ·5 ·6 ·7 ·8 ·9· d ·1. ·2. ·3. ·4. ·5. ·6. ·7. ·8. ·9. Wherein, the F functional mode represents an always OFF status; the O functional mode represents an always ON status; the 1–9 functional mode represents after detecting 15 seconds of dark, the photo-timer module will turn on a neon lamp continually according with the choice time of the 1–9 functional mode; the d functional mode represents after detecting 15 seconds of dark, the photo-timer module will turn on a neon lamp continually and after detecting 15 seconds of dawn will turn off a neon lamp; the 1.–9. functional mode represents the photo-timer module will turn on a neon lamp continually according with the choice time of the 1–9 functional mode and will repeat once per 24 hours.

While the invention has been described with reference to a preferred embodiment thereof, it is to be understood that modifications or variations may be easily made without departing from the spirit of this invention, which is defined by the appended claims.

What is claimed is:

1. A photo-timer module, comprising:

an upper cover having a hollow window;

a lower cover affixed to said upper cover;

a control and power circuit placed into said upper cover, wherein a portion of said control and power circuit is revealed in said hollow window, said control and power circuit having a plurality of input pins and a plurality of output pins wherein the plurality of input pins and the plurality of output pins are stretching out of said lower cover;

a mask plate placed above said hollow having at least one hole thereon, such that a portion of said control and power circuit is revealed in said hollow window, and a transparent plate placed above said mask plate is used for protecting and convenient observing said control and power circuit;

after assembly, said control and power circuit could control a power on or off by sensing variation of a light and showing one of a dawn and dark status of the light on said hollow window.

2. A photo-timer module as claimed in claim 1, wherein one side of said upper cover is connected with said lower cover.

3. A photo-timer module as claimed in claim 1, wherein said lower cover further comprises a plurality of holes for fixing.

4. A photo-timer module as claimed in claim 1, wherein said control and power circuit further comprising:

an AC/DC step-down and regulation circuit is coupled to a AC power source for rectification said AC power source into a DC power and regulation of said DC power;

an indicator for indicating an output status;

a function key for selecting a functional mode;

a micro-controller is coupled to said AC/DC step-down and regulation circuit, said indicator and said function key, for controlling the operation of said control and power circuit according with the setting of said function key;

a display element is coupled to said micro-controller for displaying said functional mode;

a sensor element for sensing a dawn/dark status;

a delay circuit is coupled to said sensor element for determining said dawn/dark status that is sensed whether continues a delay time; and an output device is coupled to said micro-controller for accepting the controlling of said micro-controller to make said AC power source become normal open or normal close.

5. A photo-timer module as claimed in claim 4, wherein said sensor element is a photo-resistor preferably.

6. A photo-timer module as claimed in claim 4, wherein said display element is a 7-segment LED display preferably.

7. A photo-timer module as claimed in claim 4, wherein said delay time is 15 seconds for the purpose of avoiding error action due to short-time shadow or light.

8. A photo-timer module as claimed in claim 4, wherein said indicator is a neon lamp preferably.

9. A photo-timer module as claimed in claim 4, wherein the display sequence of said functional mode is F ·O ·1 ·2 ·3 ·4 ·5 ·6 ·7 ·8 ·9 d ·1. ·2. ·3. ·4. ·5. ·6. ·7. ·8. ·9.

10. A photo-timer module as claimed in claim 9, wherein said F functional mode represents an always OFF status.

11. A photo-timer module as claimed in claim 9, wherein said O functional mode represents an always ON status.

12. A photo-timer module as claimed in claim 9, wherein said 1–9 functional mode represents after detecting 15 seconds of dark, the photo-timer module will turn on a neon lamp continually according with the choice time of said 1–9 functional mode.

13. A photo-timer module as claimed in claim 4, wherein said d functional mode represents after detecting 15 seconds of dark, the photo-timer module will turn on a neon lamp continually and after detecting 15 seconds of dawn will turn off a neon lamp.

14. A photo-timer module as claimed in claim 4, wherein said 1.–9. functional mode represents the photo-timer module willing turn on a neon lamp continually according with the choice time of said 1–9 functional mode and willing repeat once per 24 hours.

* * * * *